US010543498B2

(12) United States Patent
Jing et al.

(10) Patent No.: US 10,543,498 B2
(45) Date of Patent: Jan. 28, 2020

(54) SEALANT COATING NOZZLE AND SEALANT COATING APPARATUS

(71) Applicants: BOE Technology Group Co., Ltd., Beijing (CN); Hefei BOE Optoelectronics Technology Co., Ltd., Hefei (CN)

(72) Inventors: Yangkun Jing, Beijing (CN); Xiaopan Che, Beijing (CN); Kai Wang, Beijing (CN); Hui Jiang, Beijing (CN); Zhiwei Xu, Beijing (CN)

(73) Assignees: BOE Technology Group Co., Ltd., Beijing (CN); Hefei BOE Optoelectronics Technology Co., Ltd., Hefei, Anhui (CN)

( * ) Notice: Subject to any disclaimer, the term of this patent is extended or adjusted under 35 U.S.C. 154(b) by 463 days.

(21) Appl. No.: 15/310,715

(22) PCT Filed: Jan. 27, 2016

(86) PCT No.: PCT/CN2016/072295

§ 371 (c)(1),
(2) Date: Nov. 11, 2016

(87) PCT Pub. No.: WO2017/045330

PCT Pub. Date: Mar. 23, 2017

(65) Prior Publication Data

US 2018/0221901 A1 Aug. 9, 2018

(30) Foreign Application Priority Data

Sep. 18, 2015 (CN) ..... 2015 1 0600075

(51) Int. Cl.
*B05B 11/04* (2006.01)
*B05C 11/10* (2006.01)

(52) U.S. Cl.
CPC ..... *B05B 11/04* (2013.01); *B05C 11/10* (2013.01)

(58) Field of Classification Search
CPC ..... B05C 11/10; B05C 5/0225; B05B 11/04
(Continued)

(56) References Cited

U.S. PATENT DOCUMENTS 4,030,640 A 6/1977 Citrin et al.
4,533,082 A * 8/1985 Maehara ..... B05B 17/0646 239/102.2
(Continued)

FOREIGN PATENT DOCUMENTS

CN 1449345 A 10/2003
CN 1562398 A 1/2005
(Continued)

OTHER PUBLICATIONS

Mar. 10, 2017—(CN) Second Office Action Appn 201510600075.8 with English Tran.
(Continued)

*Primary Examiner* — Patrick M. Buechner
*Assistant Examiner* — Michael J. Melaragno
(74) *Attorney, Agent, or Firm* — Banner & Witcoff, Ltd.

(57) ABSTRACT

A sealant coating nozzle and a sealant coating apparatus are provided. The sealant coating nozzle includes a nozzle cavity, a nozzle opening communicated with the nozzle cavity, telescopic inner films located in the nozzle cavity and driving apparatuses configured to drive the telescopic inner films to deform in the nozzle cavity; a volume of the nozzle cavity is reduced by the telescopic inner films in a first deformation state to extrude sealant in the nozzle cavity via the nozzle opening, and the volume of the nozzle cavity is
(Continued)

increased by the telescopic inner films in a second deformation state to suck the sealant at the nozzle opening into the nozzle cavity.

10 Claims, 5 Drawing Sheets

(58) Field of Classification Search
USPC ..... 222/214
See application file for complete search history.

(56) References Cited

U.S. PATENT DOCUMENTS 5,242,083 A * 9/1993 Christine ..... A47K 5/122 222/105
5,743,960 A * 4/1998 Tisone ..... B01L 3/0265 118/305
5,958,342 A * 9/1999 Gamble ..... B01J 19/0046 347/1
6,063,339 A * 5/2000 Tisone ..... B01J 19/0046 422/509
6,082,629 A 7/2000 Lee et al.
6,407,481 B1 * 6/2002 Takeuchi ..... H01L 41/0926 310/324
6,588,884 B1 * 7/2003 Furlani ..... B41J 2/14427 347/54
6,598,765 B2 * 7/2003 Pagel ..... B05C 5/0225 222/181.3
6,599,755 B1 * 7/2003 Eipel ..... B01L 3/0268 422/547
6,713,021 B1 * 3/2004 Shvets ..... B01L 3/0265 137/487.5
6,874,699 B2 * 4/2005 Larson ..... B01L 3/0268 239/102.1
7,144,099 B2 * 12/2006 Cabal ..... B41J 2/14427 347/54
7,221,075 B2 * 5/2007 Nanataki ..... H01L 41/098 310/324
7,438,858 B2 * 10/2008 Shvets ..... B01L 3/0265 251/129.08
8,701,942 B2 * 4/2014 Nilsson ..... A47K 5/1209 222/207
9,056,454 B2 * 6/2015 Machida ..... B41J 2/045
9,427,961 B2 * 8/2016 Palmieri ..... B41J 2/14233
9,533,502 B2 * 1/2017 Machida ..... B41J 2/14233
2002/0150511 A1 * 10/2002 Wiktor ..... B01L 3/022 422/400
2004/0072364 A1 * 4/2004 Tisone ..... B01J 19/0046 436/180
2004/0079768 A1 * 4/2004 Kiguchi ..... B41J 2/04506 222/420
2004/0113980 A1 6/2004 Lewis et al.
2007/0116861 A1 * 5/2007 Maruyama ..... B05C 5/0216 427/64
2009/0060793 A1 * 3/2009 Eickhoff ..... G01N 35/10 422/400
2010/0102093 A1 * 4/2010 Ham ..... B05B 1/086 239/101
2010/0214368 A1 8/2010 Kim et al.
2010/0320226 A1 * 12/2010 Nilsson ..... A47K 5/1209 222/207
2010/0327019 A1 * 12/2010 Nilsson ..... A47K 5/1209 222/214
2011/0159701 A1 6/2011 Nakashima et al.
2012/0304929 A1 * 12/2012 Ivri ..... F04B 43/046 118/712
2013/0120506 A1 * 5/2013 Palmieri ..... B41J 2/14233 347/71

FOREIGN PATENT DOCUMENTS

CN 1642828 A 7/2005
CN 102962170 A 3/2013
CN 203417812 U 2/2014
CN 105032717 A 11/2015
WO 2011155440 A1 12/2011

OTHER PUBLICATIONS

Jun. 30, 2016—(WO) International Search Report and Written Opinion Appn PCT/CN2016/072295 with English Tran.
Dec. 21, 2016—(CN) First Office Action Appn 201510600075.8 with English Tran.

* cited by examiner

SEALANT COATING NOZZLE AND SEALANT COATING APPARATUS

The application is a U.S. National Phase Entry of International Application No. PCT/CN2016/072295 filed on Jan. 27, 2016, designating the United States of America and claiming priority to Chinese Patent Application No. 201510600075.8 filed on Sep. 18, 2015. The present application claims priority to and the benefit of the above-identified applications and the above-identified applications are incorporated by reference herein in their entirety.

TECHNICAL FIELD

Embodiments of the present disclosure relate to a sealant coating nozzle and a sealant coating apparatus.

BACKGROUND

A liquid crystal panel of a Thin Film Transistor Liquid Crystal Display (TFT-LCD) mainly comprises: a color filter substrate and an array substrate which are cell-aligned, as well as a liquid crystal layer filled between the color filter substrate and the array substrate.

The process of cell-aligning the color filter substrate and the array substrate that are prepared in advance is called as a "cell-aligning process". The process comprises: dripping liquid crystal in a display region of one substrate, and uniformly coating sealant in a peripheral region of another substrate using a sealant coating apparatus; after the above processes are completed, cell-aligning the two substrates (opposite to each other), and curing the sealant to attach the two substrates and thus forming a liquid crystal cell.

SUMMARY

Embodiments of the present disclosure provide a sealant coating nozzle, comprising a nozzle cavity, a nozzle opening communicated with the nozzle cavity, deformable inner films located in the nozzle cavity and driving apparatuses configured to drive the deformable inner films to deform in the nozzle cavity, wherein, a volume of the nozzle cavity is reduced by the deformable inner films in a first deformation state to extrude sealant in the nozzle cavity via the nozzle opening, and the volume of the nozzle cavity is increased by the deformable inner films in a second deformation state to suck the sealant at the nozzle opening into the nozzle cavity.

In one embodiment of the present disclosure, the driving apparatuses comprise at least an extruding driving apparatus and a sucking driving apparatus.

In one embodiment of the present disclosure, the nozzle opening is disposed at one end of the nozzle cavity, and an output side of the extruding driving apparatus and a corresponding deformable inner film are disposed at the other end opposite to the nozzle opening in the nozzle cavity; and an output side of the sucking driving apparatus and a corresponding deformable inner film are disposed along the side wall of the nozzle cavity.

In one embodiment of the present disclosure, the output side of the sucking driving apparatus and the corresponding deformable inner film are disposed close to the nozzle opening.

In one embodiment of the present disclosure, the driving apparatuses are bending deformable piezoelectric patches, the deformable inner films are attached to surfaces of the bending deformable piezoelectric patches and are deformed along with deformation of the bending deformable piezoelectric patches.

In one embodiment of the present disclosure, the sucking driving apparatus is disposed around the side wall of the nozzle cavity.

In one embodiment of the present disclosure, the driving apparatuses are linear displacement output stepmotors, and the deformable inner films are connected to output ends of the linear displacement output stepmotors.

In one embodiment of the present disclosure, the driving apparatuses are deformable piezoelectric patches, the deformable piezoelectric patches constitute the side wall of the nozzle cavity, the deformable inner films are attached to inside surfaces of the deformable piezoelectric patches and are deformed along with deformation of the deformable piezoelectric patches.

In one embodiment of the present disclosure, a cross section of the nozzle cavity is an equilateral but unequiangular hexagon.

Embodiments of the present disclosure provide a sealant coating apparatus, comprising a storage cavity, a power pushing part, at least one connecting conduit, the above described sealant coating nozzle and a control unit, wherein: the connecting conduit is connected to the storage cavity and the nozzle cavity of the sealant coating nozzle, and the connecting conduit is provided with a valve; the power pushing part is configured to push the sealant in the storage cavity into the nozzle cavity via the connecting conduit when the valve of the connecting conduit is opened; and the control unit is in signal communication with the driving apparatuses of the sealant coating nozzle, and is configured to control a deformed state of the deformed inner films of the sealant coating nozzle.

In one embodiment of the present disclosure, in the above described sealant coating apparatus, when the driving apparatuses comprise at least an extruding driving apparatus and a sucking driving apparatus: the control unit is configured to output a first pulse signal to the extruding driving apparatus and periodically control the extruding control apparatus to drive the corresponding deformable inner film to be in the first deformation state; and output a second pulse signal to the sucking driving apparatus and periodically control the sucking control apparatus to drive the corresponding deformable inner film to be in the second deformation state.

In one embodiment of the present disclosure, in the above described sealant coating apparatus, the first pulse signal and the second pulse signal have the same phase and same pulse width, each pulse width of the first pulse signal includes a first level rising stage, a second level rising stage and a first level falling stage which are arranged in sequence, and each pulse width of the second pulse signal includes a third level rising stage corresponding to the first level rising stage and the second level rising stage and a second level falling stage corresponding to the first level falling stage.

In one embodiment of the present disclosure, in the above described sealant coating apparatus, the control unit is further in signal communication with the valve and the power pushing part, and is configured to output a third pulse signal to the valve, periodically controls the valve to open, outputs a fourth pulse signal to the power pushing part and periodically controls the power pushing part to push the sealant in the storage cavity into the nozzle cavity via the connecting conduit when the valve of the connecting conduit is opened, and a pulse interval stage of the fourth pulse signal is not overlapped with pulse interval stages of the first pulse signal and the second pulse signal.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

REFERENCE SIGNS

1—air conduit; 2—storage cavity; 3—nozzle; 4—pipeline; 11—nozzle cavity; 21—nozzle opening; 31, 32*a*, 31*b*—deformable inner films; 41, 41*a*, 41*b*—bending deformable piezoelectric patches; 5*a*, 5*b*—linear displacement output stepmotors; 8—power pushing part; 9—connecting conduit; 10—valve; 12—stepmotor; 13—deformable piezoelectric patch; 14—sealant coating nozzle; 101*a*—first pulse signal; 101*b*—second pulse signal; 101*d*—fourth pulse signal.

DETAILED DESCRIPTION

In order to make objects, technical details and advantages of the embodiments of the disclosure apparent, the technical solutions of the embodiment will be described in a clearly and fully understandable way in connection with the drawings related to the embodiments of the disclosure. It is obvious that the described embodiments are just a part but not all of the embodiments of the disclosure. Based on the described embodiments herein, those skilled in the art can obtain other embodiment(s), without any inventive work, which should be within the scope of the disclosure.

Figure 1:
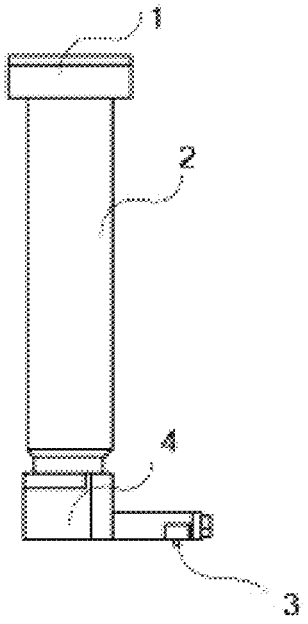
FIG. 1 is a schematic diagram of an conventional sealant coating nozzle.

FIG. 1 is a schematic diagram of a conventional sealant coating nozzle, which comprises a storage cavity 2 for storing sealant, an air conduit 1 disposed above the storage cavity 2 and communicated with the storage cavity 2, and a nozzle 3 disposed below the storage cavity 2 and communicated with the storage cavity 2 through a pipeline 4. When the sealant is coated, firstly, the sealant is filled into the storage cavity 2. Then air is inflated into the storage cavity 2 through the air conduit 1. Due to air pressure, the sealant is extruded to move downwards along the inner wall of the storage cavity 2 and is sprayed out through the nozzle 3. At this time, the position required to be coated with sealant on a substrate is just conveyed to somewhere below the nozzle 3 by a conveying device, such that the sealant is coated to the corresponding position on the substrate.

One deficiency in the above process is that when the above sealant coating apparatus is used for coating sealant, a sealant throwing phenomenon often occurs, i.e., the sealant is dripped into a display region of the substrate, resulting in poor product.

In order to avoid the sealant throwing phenomenon in the sealant coating process and improve a product yield, embodiments of the present disclosure provide a sealant coating nozzle and a sealant coating apparatus.

In order to make the objectives, technical solutions and advantages of the present disclosure more apparent, the embodiments are listed below to describe the present disclosure in detail.

The sealant coating nozzle provided by the embodiments of the present disclosure comprises a nozzle cavity, a nozzle opening communicated with the nozzle cavity, deformable inner films located in the nozzle cavity and driving apparatuses configured for driving the deformable inner films to deform in the nozzle cavity. A volume of the nozzle cavity is reduced by the deformable inner films in a first deformation state to extrude the sealant in the nozzle cavity via the nozzle opening, and the volume of the nozzle cavity is increased by the deformable inner films in a second deformation state to suck the sealant on the nozzle opening into the nozzle cavity.

In the technical solution of the embodiment of the present disclosure, the deformation state of the deformable inner films in the nozzle cavity can be controlled by controlling the driving apparatuses. When the deformable inner films are in the first deformation state, the volume in the nozzle cavity is reduced, pressure intensity is increased, and the sealant is extruded via the nozzle opening; when the deformable inner films are in the second deformation state, the volume in the nozzle cavity is increased, the pressure intensity is reduced, and the sealant at the nozzle opening is sucked back. Therefore, the sealant will not be dripped on the substrate, such that the sealant throwing phenomenon is avoided and the product yield is improved.

In one embodiment of the present disclosure, the driving apparatuses comprise at least an extruding driving apparatus and a sucking driving apparatus. An output side of the extruding driving apparatus and a corresponding deformable inner film are disposed at the bottom of the nozzle cavity, and an output side of the sucking driving apparatus and a corresponding deformable inner film are disposed along the side wall of the nozzle inner cavity.

When the sealant in the nozzle cavity needs to be extruded, the deformable inner film corresponding to the extruding driving apparatus is controlled to be in the first deformation state to extrude the sealant; when the sealant in the nozzle cavity needs to be sucked, the deformable inner film corresponding to the sucking driving apparatus is controlled to be in the second deformation state to suck the sealant. Since the extruding and sucking of the sealant are performed by different driving apparatuses, only extrusion correction is needed for a pulse signal output from the extruding driving apparatus, such that precision of an extruded volume of the sealant is improved.

In one embodiment of the present disclosure, the output side of the sucking driving apparatus and the corresponding deformable inner film are disposed close to the nozzle opening. Therefore, the sucking effect of the sealant on the nozzle opening is improved.

For example, the sucking driving apparatus is disposed around the side wall of the nozzle cavity. Due to such arrangement, the volume of the nozzle cavity is changed more uniformly, and it is favorable to improve the sucking precision of the sealant on the nozzle opening and further improve the sucking effect.

Figure 2A:
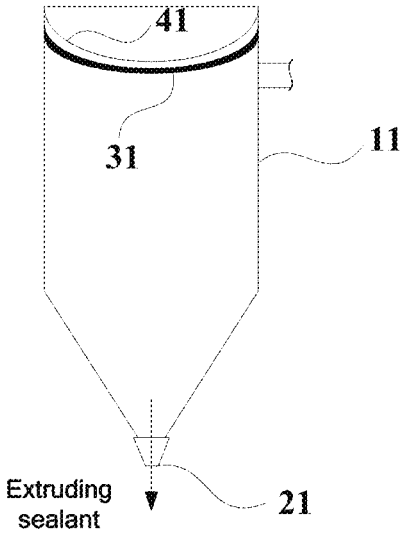
FIG. 2*a* is a structural schematic diagram of a sealant coating nozzle according to a first embodiment of the present disclosure (in an extruding state)
Figure 2B:
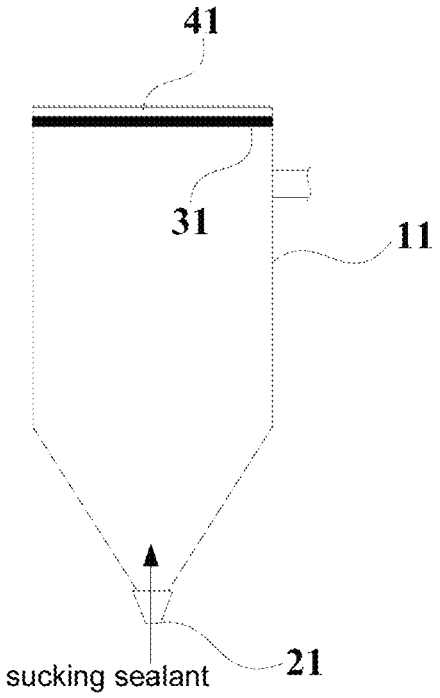
FIG. 2*b* is a structural schematic diagram of the sealant coating nozzle according to the first embodiment of the present disclosure (the sealant of a nozzle opening is in a sucking state)

As shown in FIG. 2*a* and FIG. 2*b*, in one embodiment of the present disclosure, the driving apparatuses adopt bending deformable piezoelectric patches 41, the deformable inner films 31 are attached to surfaces of the bending deformable piezoelectric patches 41 and are deformed along with deformation of the bending deformable piezoelectric patches 41.

In the embodiments of the present disclosure, the bending deformable piezoelectric patches 41 are not limited to specific types, for example, common ceramic piezoelectric patches can be adopted. The bending deformable piezoelectric patches 41 have two deformation states, i.e., a bending arching state and a reset state. The deformation state of the deformable inner films 31 is consistent with that of the bending deformable piezoelectric patches 41. The volume of the nozzle cavity 11 is reduced by the deformable inner films 31 in the first deformation state, i.e., the bending arching state as shown in FIG. 2*a*, such that pressure in the nozzle cavity 11 is increased to extrude the sealant in the nozzle cavity 11 via the nozzle opening 21; and the volume of the nozzle cavity 11 is increased by the deformable inner films 31 in a second deformation state, i.e., the reset state as shown in FIG. 2*b* to suck the sealant on the nozzle opening 21 into the nozzle cavity 11.

Since the wall hanging resistance of the piezoelectric patches to the sealant is relatively large, in order to reduce the wall hanging resistance of the sealant, the deformable inner films 31 may be a thin film with high lubricity and low adhesion, such as teflon. The deformable inner films 31 can be attached or plated to the surfaces of the piezoelectric patches 41.

Figure 3A:
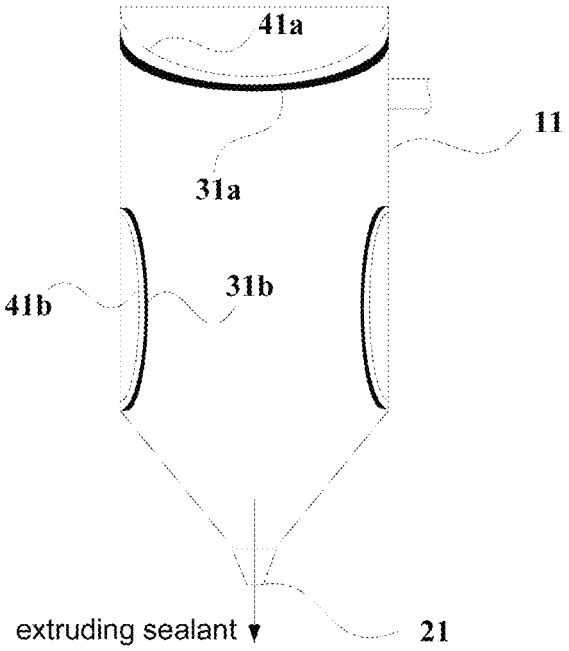
FIG. 3*a* is a structural schematic diagram of a sealant coating nozzle according to a second embodiment of the present disclosure (in an extruding state)
Figure 3B:
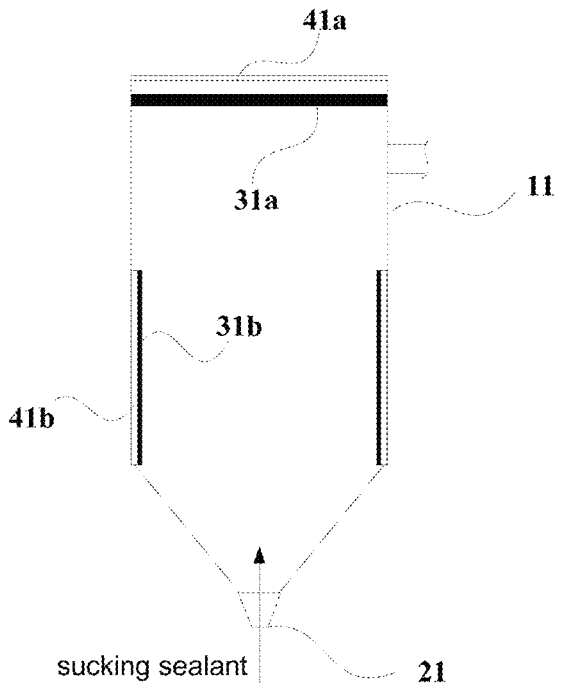
FIG. 3*b* is a structural schematic diagram of the sealant coating nozzle according to the second embodiment of the present disclosure (the sealant of a nozzle opening is in a sucking state)

As shown in FIGS. 3*a* and 3*b*, in the present embodiment, the extruding driving apparatus and the sucking driving apparatus are both bending deformable piezoelectric patches 41, respectively including a bending deformable piezoelectric patch 41*a* and a bending deformable piezoelectric patch 41*b*; the deformable inner films 31*a* and 31*b* are attached to the surfaces of both piezoelectric patches. In addition, the bending deformable piezoelectric patch 41 as the sucking driving apparatus is disposed close to the nozzle opening 21. The bending deformable piezoelectric patch 41 as the sucking driving apparatus is disposed around the side wall of the nozzle cavity 11 and is cylindrical. It needs to be noted that in other embodiments of the present disclosure, a plurality of bending deformable piezoelectric patches 41*b* as the sucking driving apparatus can be disposed along the side wall of the nozzle cavity.

As shown in FIG. 3*a* and FIG. 3*b*, the bending deformable piezoelectric patch 41*a* is disposed at the bottom of the nozzle cavity. According to its disposing position, better effects can be achieved by setting it to be an extruding driving apparatus. The bending deformable piezoelectric patch 41*b* is disposed along the side wall of the nozzle cavity 11 and is close to the nozzle opening 21, and can rapidly cause a change of pressure at the part of the nozzle cavity 11 close to the nozzle opening 21 if reset, such that the sucking effect of the nozzle opening 21 to the sealant can be improved, and the sealant throwing phenomenon can be further prevented. Since the bending deformable piezoelectric patch 41*a* is mainly used to extrude the sealant, its deformation is large; since the bending deformable piezoelectric patch 41*b* is mainly used to suck the sealant at the nozzle opening, its deformation is relatively small. When the bending deformable piezoelectric patch 41*a* is deformed to extrude the sealant, the bending deformable piezoelectric patch 41*b* generates slow bending deformation, which generates certain buffering to the rapid reduction of the volume in the nozzle cavity 11 when the sealant is extruded, such that a stable sealant extruding rate of the nozzle is ensured; after sealant extruding, the bending deformable piezoelectric patch 41*a* and the bending deformable piezoelectric patch 41*b* are rapidly reset, and the sealant at the nozzle opening is sucked back under the main action of the bending deformable piezoelectric patch 41*b*.

During sealant coating, high precision is required on the extruded volume of the sealant. In the present embodiment, the extruding and sucking of the sealant are respectively performed by different driving apparatuses, only extruding corrections are needed for the pulse signal output from the driving apparatus and the sucking correction is not needed, and compared with the embodiment as shown in FIG. 2*a* and FIG. 2*b*, the correction frequency can be reduced, such that the precision of the extruded volume of the sealant is improved.

Figure 4:
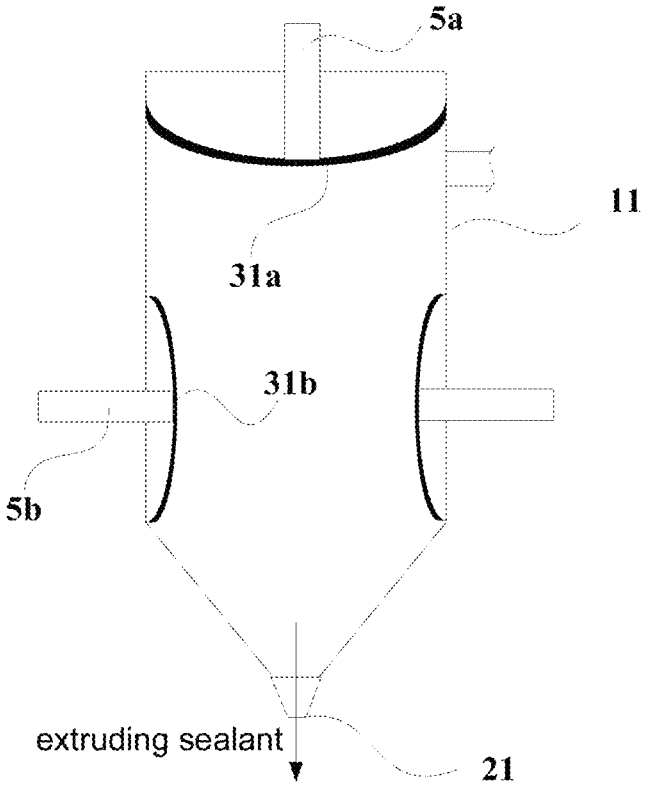
FIG. 4 is a structural schematic diagram of a sealant coating nozzle according to a third embodiment of the present disclosure (in an extruding state)

In another embodiment, as shown in FIG. 4, the extruding driving apparatus and the sucking driving apparatus are both linear displacement output stepmotors, respectively including a linear displacement output stepmotor 5*a* and a linear displacement output stepmotor 5*b*, and the deformable inner film 31*a*/31*b* is connected to the output end of the corresponding linear displacement output stepmotor 5*a*/5*b*. By making the output end of the linear displacement output stepmotor 5*a* as the extruding driving apparatus extend, the deformable inner film 31*a* is in the first deformation state to extrude the sealant; when the sealant on the nozzle opening needs to be sucked, the output end of the linear displacement output stepmotor 5*b* as the sucking driving apparatus is controlled to be retracted to make the deformable inner film 31*b* be in the second deformation state, such that the sealant at the nozzle opening is sucked.

Figure 5:
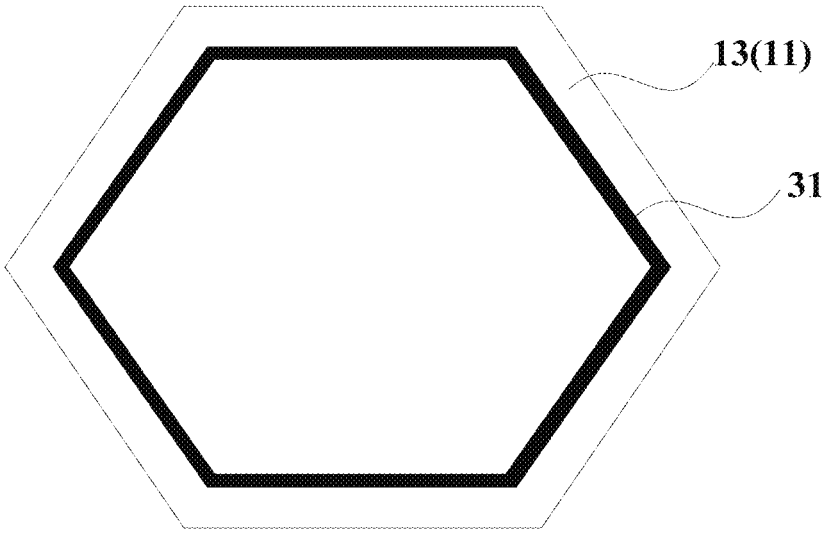
FIG. 5 is a sectional structural schematic diagram of a nozzle cavity of a sealant coating nozzle according to a fourth embodiment of the present disclosure.

As shown in FIG. 5, in the present embodiment, the driving apparatuses are deformable piezoelectric patches 13, the deformable piezoelectric patches 13 constitute the side wall of the nozzle cavity 11, the deformable inner films 31 are attached to inside surfaces of the deformable piezoelectric patches 13 and are deformed along with deformation of the deformable piezoelectric patches 13. By making the deformable piezoelectric patches 13 retract, the volume of the nozzle cavity 11 can be reduced to extrude the sealant; when the sealant at the nozzle opening needs to be sucked back, the deformable piezoelectric patches 13 are controlled to expand to increase the volume of the nozzle cavity 11, such that the sealant at the nozzle opening is sucked.

For example, the side wall of the nozzle cavity 11 is an equilateral but unequiangular hexagonal side wall. By adopting the equilateral inner retracting design, the change of the volume in the nozzle cavity 11 is more uniform, such that the sucking precision of the sealant at the nozzle opening is improved and the sucking effect is further improved.

Figure 6:
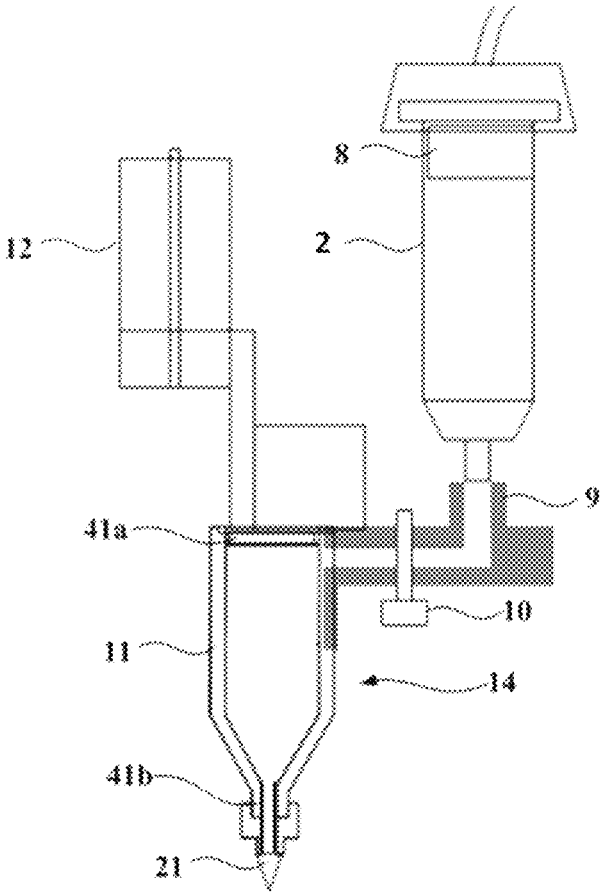
FIG. 6 is a structural schematic diagram of a sealant coating apparatus according to a fifth embodiment of the present disclosure.

As shown in FIG. 6, an embodiment of the present disclosure further provides a sealant coating apparatus, comprising a storage cavity 2, a power pushing part 8, at least one connecting conduit 9, a sealant coating nozzle 14 and a control unit (not shown).

The connecting conduit 9 is connected to the storage cavity 2 and the nozzle cavity 11 of the sealant coating nozzle 14, and the connecting conduit 9 is provided with a valve 10; the power pushing part 8 is configured to push the sealant in the storage cavity 2 into the nozzle cavity 11 via the connecting conduit 9 when the valve 10 of the connecting conduit 9 is opened; and the control unit is in signal communication with the driving apparatuses of the sealant coating nozzle 14, and is configured to control a deformed state of the deformed inner films of the sealant coating nozzle 14.

The sealant coating apparatus as shown in FIG. 6 further comprises a stepmotor 12 for controlling the height of the nozzle. The valve 10, for example, can adopt an electric control valve, and the control unit is further in signal communication with the stepmotor 12 and the electric control valve, thereby realizing related control. The type of the power pushing part 8 is not limited, for example, can be a piston or compressed air inflating pipe, etc.

Figure 7:
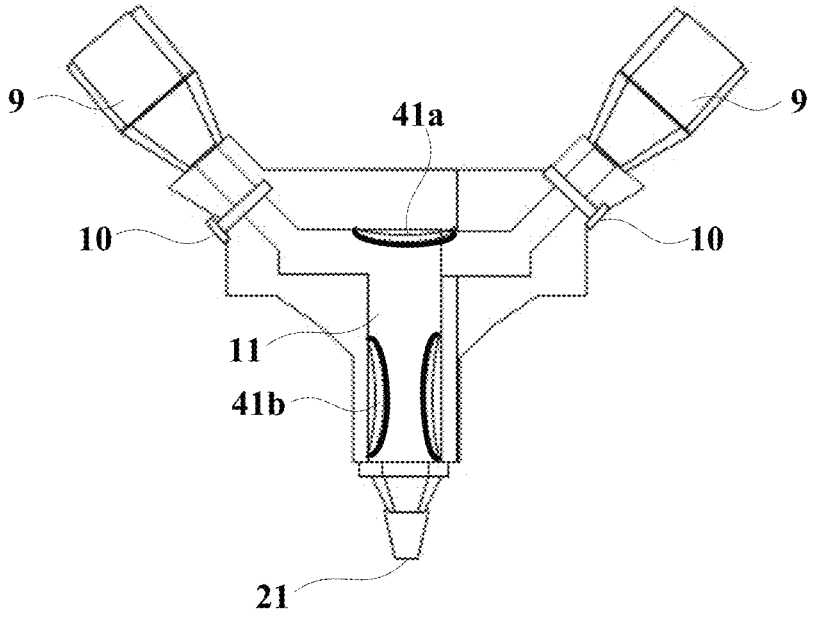
FIG. 7 is a partial structural schematic diagram of a sealant coating apparatus according to a sixth embodiment of the present disclosure.

In the present embodiment, one connecting conduit 9 is disposed. In other embodiments of the present disclosure, as shown in FIG. 7, two connecting conduits 9 are disposed. In some cases, the number of connecting conduits can also be three or more. By a plurality of connecting conduits, the sealant can be rapidly and uniformly guided into the nozzle cavity, thereby facilitating improving the coating efficiency.

In the sealant coating apparatus of the embodiment of the present disclosure, the control unit controls the deformation state of the deformable inner films in the nozzle cavity by controlling the driving apparatuses. When the deformable inner films are in the first deformation state, the volume of the nozzle cavity is reduced and the sealant is extruded via the nozzle opening; when the deformable inner films are in the second deformation state, the volume in the nozzle cavity is increased, the intensity of pressure is reduced, and the sealant on the nozzle opening is sucked back. By adopting the sealant coating apparatus to coat the sealant, the sealant will not be dripped on the substrate, such that the sealant throwing phenomenon is avoided and the product yield is improved.

For example, with respect to the sealant coating apparatus as shown in FIG. 6, the control unit is configured to output a first pulse signal to the extruding driving apparatus and periodically control the extruding control apparatus to drive the corresponding deformable inner film to be in a first deformation state; and output a second pulse signal to the sucking driving apparatus and periodically control the sucking control apparatus to drive the corresponding deformable inner film to be in a second deformation state.

The extruding and sucking of the sealant are performed by respective driving apparatuses; only extrusion corrections are needed for the first pulse signal output to the extruding driving apparatus, such that the precision of the extruded volume of the sealant is improved.

Figure 8:
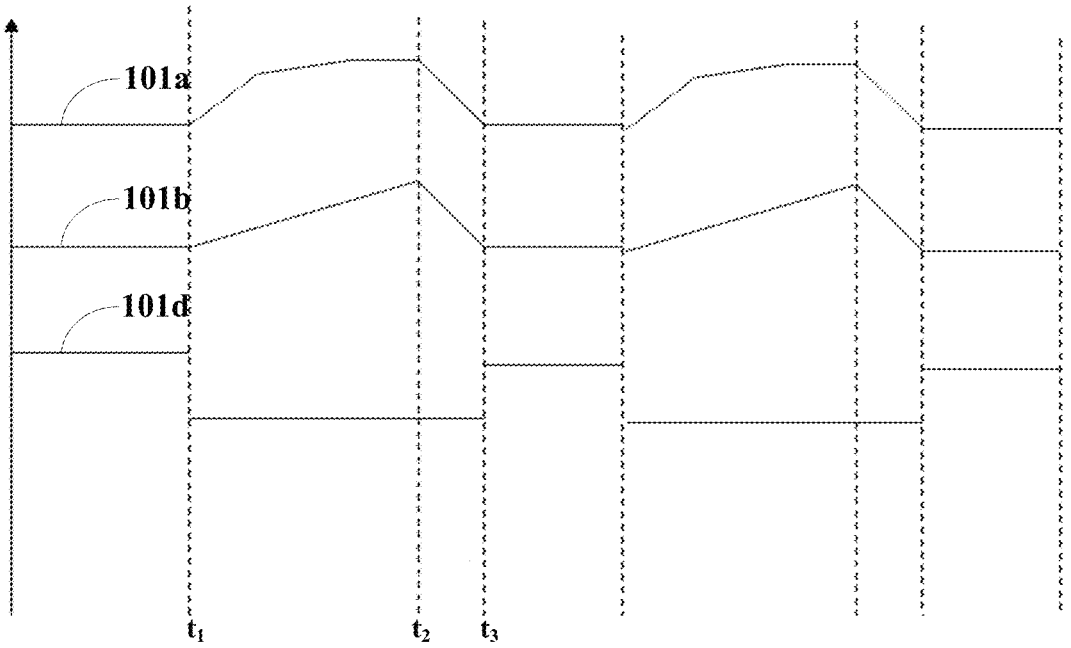
FIG. 8 is a schematic diagram of a pulse wave received by a bending deformable piezoelectric patch 41*a*, a bending deformable piezoelectric patch 41*b* and a valve 10.

In another embodiment of the present disclosure, as shown in FIG. 8, the first pulse signal 101*a* output to the bending deformable piezoelectric patch 41*a* and the second pulse signal 101*b* output to the bending deformable piezoelectric patch 41*b* have the same phase and same pulse width. Each pulse width of the first pulse signal 101*a* includes a first level rising stage, a second level rising stage and a first level falling stage which are arranged in sequence, and each pulse width of the second pulse signal 101*b* includes a third level rising stage corresponding to the first level rising stage and the second level rising stage and a second level falling stage corresponding to the first level falling stage.

In the first level rising stage and the second level rising stage (stage t1-t2) of the first pulse signal 101*a*, the bending deformable piezoelectric patch 41*a* is bent and arched to extrude the sealant, meanwhile, the bending deformable piezoelectric path 41*b* is slowly deformed to generate certain buffering to the rapid reduction of the volume in the nozzle cavity, such that a stable sealant extruding rate of the nozzle is ensured; in the first level falling stage of the first pulse signal 101*a* (stage t2-t3), the bending deformable piezoelectric patch 41*a* and the bending deformable piezoelectric patch 41*b* are rapidly reset, and the sealant on the nozzle opening is sucked under the main action of the bending deformable piezoelectric patch 41*b*.

In another embodiment of the present disclosure, the control unit is further in signal communication with the valve and the power pushing part, and is configured to output a third pulse signal to the valve, periodically open the valve, output a fourth pulse signal (referring to the fourth pulse signal 101*d* in FIG. 8) to the power pushing part and periodically control the power pushing part to push the sealant in the storage cavity into the nozzle cavity via the connecting conduit when the valve of the connecting conduit is opened, wherein, a pulse interface stage of the fourth pulse signal 101*d* (i.e., the stage where the level is zero) is not overlapped with pulse interface stages of the first pulse signal 101*a* and the second pulse signal 101*b*.

One working circulation process of the sealant coating apparatus as shown in FIG. 6 is conducted as follows:

The valve 10 is opened, the power pushing part 8 pushes the sealant in the storage cavity 2 into the nozzle cavity 11 through the connecting conduit and then the valve 10 is closed;

The height of the sealant coating nozzle 14 relative to the substrate is adjusted;

The bending deformable piezoelectric patch 41*a* generates bending arching deformation to extrude the sealant, wherein in this process, the bending deformable piezoelectric patch 41*b* also generates slow bending arching deformation to keep a sealant extruding rate of the nozzle stable;

After a single extruding of the sealant is finished, the bending deformable piezoelectric patch 41*b* is reset, such that the sealant is sucked from the nozzle opening 21, and the bending deformable piezoelectric patch 41*a* is also reset (FIG. 6 shows the reset state).

The above are only the model implementation ways of the present disclosure, and not used to limit the scope of protection of the present disclosure, the scope of protection of the present disclosure is determined by the attached claims.

The present application claims the priority of the Chinese Patent Application No. 201510600075.8 filed on Sep. 18, 2015, which is incorporated herein by reference as part of the disclosure of the present application.

What is claimed is:

1. A sealant coating nozzle, comprising a nozzle cavity, a nozzle opening communicated with the nozzle cavity, deformable inner films located in the nozzle cavity, and driving apparatuses configured to drive the deformable inner films to deform in the nozzle cavity, wherein a volume of the nozzle cavity is reduced by the deformable inner films in a first deformation state to extrude sealant in the nozzle cavity via the nozzle opening, and the volume of the nozzle cavity is increased by the deformable inner films in a second deformation state to suck the sealant at the nozzle opening into the nozzle cavity, wherein the driving apparatuses comprise at least an extruding driving apparatus and a sucking driving apparatus, wherein the nozzle opening is disposed at one end of the nozzle cavity, and an output side of the extruding driving apparatus and a corresponding deformable inner film are disposed at the other end opposite to the nozzle opening in the nozzle cavity, wherein an output side of the sucking driving apparatus and a corresponding deformable inner film are disposed along a side wall of the nozzle cavity, and wherein the output side of the sucking driving apparatus and the corresponding deformable inner film are disposed closer to the nozzle opening than the output side of the extruding driving apparatus and the corresponding deformable inner film, wherein during extruding of the sealant, the extruding driving apparatus operates to drive the corresponding deformable inner film to extrude the sealant from the nozzle cavity and the sucking driving apparatus does not operate to drive the corresponding deformable inner film, and wherein during sucking of the sealant, the sucking driving apparatus operates to drive the corresponding deformable inner film to suck the sealant into the nozzle cavity and the extruding driving apparatus does not operate to drive the corresponding deformable inner film.

2. The sealant coating nozzle according to claim 1, wherein the driving apparatuses comprise bending deformable piezoelectric patches, the deformable inner films are attached to surfaces of the bending deformable piezoelectric patches and are able to be deformed along with deformation of the bending deformable piezoelectric patches.

3. The sealant coating nozzle according to claim 1, wherein, the sucking driving apparatus is disposed around a side wall of the nozzle cavity.

4. The sealant coating nozzle according to claim 1, wherein, the driving apparatuses are linear displacement output stepmotors, and the deformable inner films are connected to output ends of the linear displacement output stepmotors.

5. The sealant coating nozzle according to claim 1, wherein, the driving apparatuses comprise deformable piezoelectric patches, the deformable piezoelectric patches constitute a side wall of the nozzle cavity, the deformable inner films are attached to inside surfaces of the deformable piezoelectric patches and are able to be deformed along with deformation of the deformable piezoelectric patches.

6. The sealant coating nozzle according to claim 5, wherein, a cross section of the nozzle cavity is an equilateral but unequiangular hexagon.

7. A sealant coating apparatus, comprising a storage cavity, a power pushing part, at least one connecting conduit, the sealant coating nozzle according to claim 1, and a control unit, wherein:

the connecting conduit is connected to the storage cavity and the nozzle cavity of the sealant coating nozzle, and the connecting conduit is provided with a valve;

the power pushing part is configured to push the sealant in the storage cavity into the nozzle cavity via the connecting conduit when the valve of the connecting conduit is opened; and the control unit is in signal communication with the driving apparatuses of the sealant coating nozzle, and is configured to control a deformable state of the deformable inner films of the sealant coating nozzle.

8. The sealant coating apparatus according to claim 7, wherein the control unit is configured to output a first pulse signal to the extruding driving apparatus and periodically control the extruding driving apparatus to drive the corresponding deformable inner film to be in the first deformation state; and output a second pulse signal to the sucking driving apparatus and periodically control the sucking driving apparatus to drive the corresponding deformable inner film to be in the second deformation state.

9. The sealant coating apparatus according to claim 8, wherein, the first pulse signal and the second pulse signal have a same phase and a same pulse width, each pulse width of the first pulse signal includes a first level rising stage, a second level rising stage, and a first level falling stage which are arranged in sequence, and each pulse width of the second pulse signal includes a third level rising stage corresponding to the first level rising stage and the second level rising stage, and a second level falling stage corresponding to the first level falling stage.

10. The sealant coating apparatus according to claim 8, wherein, the control unit is further in signal communication with the valve and the power pushing part, and is configured to output a third pulse signal to the valve, periodically control the valve to open, output a fourth pulse signal to the power pushing part and periodically control the power pushing part to push the sealant in the storage cavity into the nozzle cavity via the connecting conduit when the valve of the connecting conduit is opened, and a pulse interval stage of the fourth pulse signal is not overlapped with pulse interval stages of the first pulse signal and the second pulse signal.

* * * * *